United States Patent [19]

Sakaki et al.

[11] Patent Number: 4,952,270

[45] Date of Patent: Aug. 28, 1990

[54] BAND FEEDING AND TIGHTENING APPARATUS IN STRAPPING MACHINE

[75] Inventors: Yasunori Sakaki, Tokyo; Tsutomu Tagomori, Yokohama; Eisaku Yamada, Tokyo, all of Japan

[73] Assignee: Strapack Corporation, Tokyo, Japan

[21] Appl. No.: 241,433

[22] Filed: Sep. 7, 1988

[30] Foreign Application Priority Data

Jan. 12, 1987 [JP] Japan ..... 62-154627[U]

[51] Int. Cl.[5] ..... B65C 13/04

[52] U.S. Cl. ..... 156/361; 100/32; 100/33 PB; 156/495

[58] Field of Search ..... 156/495, 358, 583.1, 156/73.5, 361; 100/33 PB, 26, 29, 32; 226/25

[56] References Cited

U.S. PATENT DOCUMENTS

| | | | |
|---|---|---|---|
| 3,004,728 | 10/1961 | Ihle | 226/25 X |
| 3,229,878 | 1/1966 | Hurlbut et al. | 226/25 |
| 4,145,963 | 3/1979 | Leslie et al. | 226/25 X |
| 4,454,808 | 6/1984 | Wehr et al. | 226/25 X |
| 4,595,433 | 6/1986 | Ford et al. | 100/33 PB X |

*Primary Examiner*—David Simmons

*Attorney, Agent, or Firm*—Schwartz & Weinrieb

[57] ABSTRACT

The present invention relates to a band feeding and tightening apparatus within a strapping machine wherein an external force tending to cause jamming by means of friction and the like in feeding the band pivotably rotates a chute guide constituting part of a band passage, whereby the rear end portion of the chute guide is pushed upwardly and the band which is loosened by means of a length corresponding to the height of the pushed-up portion of the chute guide is retained within the band passage, so that the external force is momentarily released and the band is smoothly fed to the outside of the main body by means of a continuously rotating feed roller and an upper roller without causing jamming and distortion of the band.

The feed roller is driven by means of a series motor and the band is fed at a high rate of speed and a low torque, and then restored so as to perform a primary tightening operation, and finally closely tightened around an article to be strapped at a low rate of speed and a high torque.

The signal of a sensor for detecting the opening of the chute guide stops the feeding of the band by means of the feed roller whereby unnecessary feeding of the band is avoided.

10 Claims, 6 Drawing Sheets

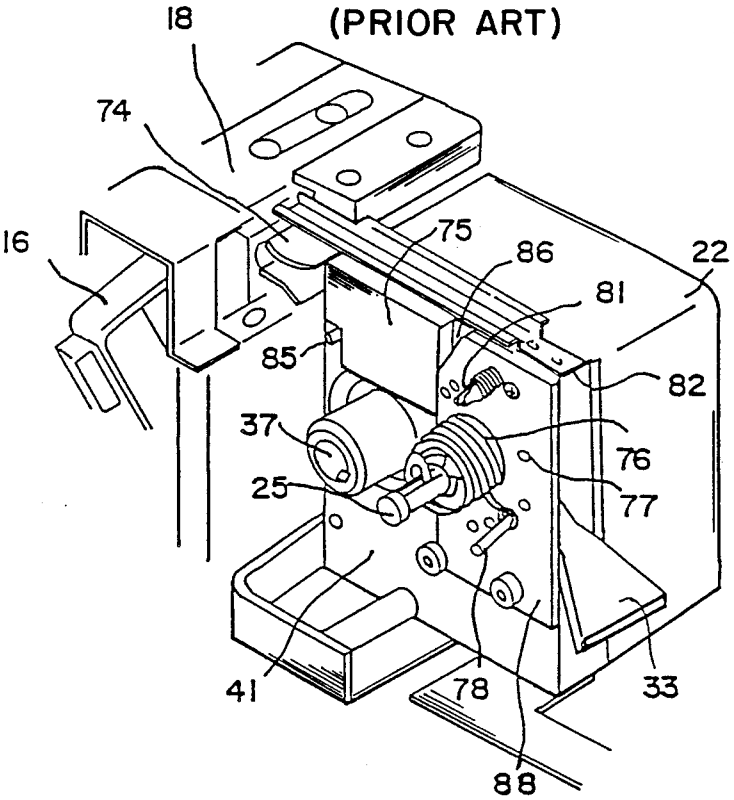
FIG. 4 (PRIOR ART)
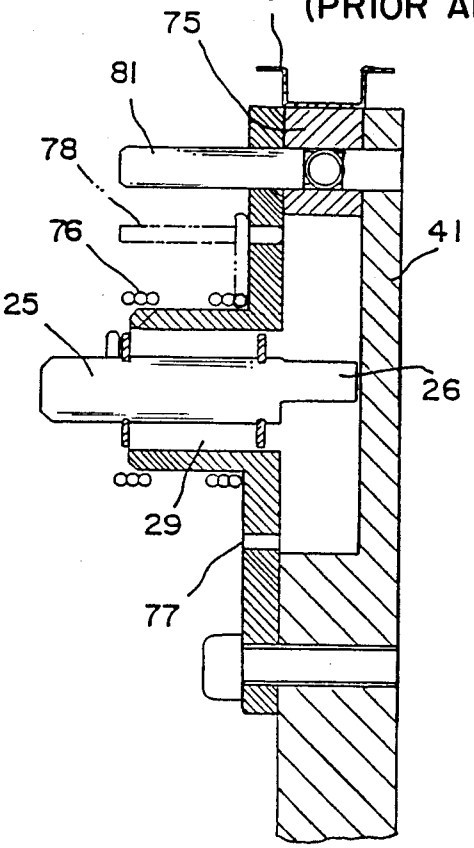
FIG. 3 (B) (PRIOR ART)

BAND FEEDING AND TIGHTENING APPARATUS IN STRAPPING MACHINE

FIELD OF THE INVENTION

The present invention relates to a band-feeding and tightening apparatus within a strapping machine which performs a process in which a pair of rollers rotating in contact with each other feed a plastic band toward the outside of a main body of the strapping machine, wherein subsequently the band, wound around an article to be strapped by means of a reverse rotation of the pair of the rollers, is restored and then wound around the article to be strapped, and finally, the band is strongly and closely bound around the article to be strapped.

BACKGROUND OF THE INVENTION

The band feeding and tightening process performed by means of the aforenoted type of strapping machine is divided into the following processes: the band is fed toward the outside of the main body and positioned around the article to be strapped by means of a band guiding arch, or alternatively, manually, a leading end of the band is grasped by means of a press member and then the band is wound around the article to be strapped by means of a band-restoring and tightening mechanism disposed within the main body so as to define a primary tightening operation, and finally tightened so as to closely bind the strap around the article to be strapped and thereby define a secondary tightening operation. If the processes are subdivided, a series of the band feeding and tightening operations are performed as band-feeding, primary tightening, and secondary tightening operations, and the strength of the band tightening force around the article to be strapped can be adjusted depending upon the kind of article to be strapped.

The applicant has proposed a band-tightening apparatus, disclosed in Japanese U.M. Laid Open Publication No. 129703/1986 and illustrated in FIGS. 2 to 4, comprising a feed motor 21 provided with a speed reducer 22 attached to a base plate 41, a feed roller 23 driven by directly connecting the same to the feed motor 21, a shaft support plate 88 provided with an upper roller 24 mounted upon the base plate 41 and rotating in contact with the feed roller 23, a freely pivotable feed cover 75 disposed downstream of both rollers as viewed in the band-passing direction of both rollers, and a band chute 74.

As illustrated in FIGS. 2 to 4, the upper roller 24 is supported upon a shaft passing through a shaft supporting plate 88 which also includes an annular projection 83 upon which a bearing 29 is mounted. In other words, the shaft support plate 88 is mounted upon the right side of the feed roller 23 so as to cover a stepped portion 66 formed upon the base plate 41, as viewed in FIG. 4. A shaft 25 is mounted upon the shaft support plate 88 through means of the bearing 29 and an eccentric shaft 26 formed integrally with the front end of the shaft 25 is provided so as to project through the shaft support plate 88 as best seen in FIG. 3(B). The eccentric shaft 26 faces the space defined to the right upper of the feed roller 23 and above the stepped portion 66 formed upon the base plate 41 and the upper roller 24 is supported by means of the eccentric shaft 26. The front end of the shaft 25, namely the outer periphery of the portion projecting outwardly from the shaft support plate 88 is provided with a torsion spring 76, one end of which is secured to the shaft 25, and the other end of which is locked to the front end of a stopper pin 78. The rear end of the stopper pin 78 is capable of insertion into and removal from a plurality of adjusting holes 77 arranged concentrically with respect to the shaft 25 of the shaft support plate 88. Accordingly, the eccentric shaft 26 is biased in the counterclockwise direction as viewed in FIG. 3(A) by means of the torsion spring 76 and is caused to pivotally rotate roller 24 in the same direction as that of the biasing force of the eccentric shaft 26, só that the upper roller 24 is brought into compressive contact with the feed roller 23. The shaft 25 of the upper roller 24 is disposed above the driving shaft 37 of the feed roller 23 at an angle of approximately 15 degrees with respect to the horizontal plane. Accordingly, the band is held between both rollers in the form of a substantially reversed letter S, such that the frictional resistance of both rollers with the band is enhanced during the tightening operation. A cut-away portion 86 is formed within plate 88 by cutting the upper end margin of the shaft support plate 88 directed toward the feed roller 23 in the form of a triangle thereby enabling the pivotal rotation of the feed cover 75 as will be described later.

The feed cover 75 is composed of a finger-shaped rear end portion and a forward end portion having a stepped portion 67 formed upon one side thereof. The rotating space of the upper roller 24 is provided beneath the rear end portion of cover 75 and is situated within the vicinity of the upstream end of the band as viewed in the band-feeding direction and a shaft 81 provided with a torsion spring 79 of a relatively weak opposing strength is mounted within the upper portion of plate 88 so as to pivotably support cover 75. Accordingly, the feed cover 75 is mounted between the shaft support plate 88 and the base plate 41 by means of the shaft 81 for enabling free pivotal rotation thereof. The front end portion of the feed cover 75 is thick enough to cover the feed roller 23 and the finger portion is disposed above the upper surface of the stepped portion 66 of the base plate 41. The lower surface of the front end portion of the feed cover 75 is provided with a stepped portion 67 which opposes the circumferential surface of the feed roller 23 through the intermediary of a gap sufficient enough for allowing rotation of the roller 23 and which also opposes the forward surface of the stepped portion 66, as viewed in the band-feeding direction, formed on the base plate 41 through the intermediary of a gap for allowing the band to pass therethrough, with the thickness of the gaps of course corresponding to the thickness of or greater than that of the band. The front end margin or the side surface of the thick portion of the feed cover 75 is disposed substantially flush with the side margin of the base plate 41. The torsion spring 79 biases the shaft 81 in the counterclockwise direction with respect to FIG. 3(A), so that the front end portion of the feed cover 75 is normally biased in the direction toward the feed roller 23 by means of its own weight.

A series of band passages 80 is defined between the stepped portion 66 of the base plate 41 and the outer peripheral surface of the upper roller 24, between the outer peripheral surfaces of both rollers 23 and 24, and between the outer peripheral surface of the feed roller 23 and the lower stepped surface 67 of the feed cover 75, and the outlet of the band passage 80 faces the inlet of the band chute 74 and the inlet of the band passage 80 faces the outlet of a band-introducing pipe 33.

The feed roller 23 is connected to the motor 21 rotating normally at a constant speed and torque through the intermediary of the speed-reducing mechanism 22.

The rotary shaft in the speed-reducing mechanism and/or the driving shaft 37 of the feed roller 23 is provided with an electromagnetic clutch, a friction clutch and a one-way clutch. The rotation of the high-speed or low-speed output shaft is transmitted to the feed roller 23 through the intermediary of a chain, a pulley and other movement transmission members. Means for varying the voltage applied to the electromagnetic clutch performs band-feeding and primary tightening at high speed and low torque and secondary tightening at low speed and high torque.

In the above-described band-feeding and tightening apparatus, the band introduced into the main body is then fed into the band chute 74 through the intermediary of the band-introducing pipe 33 and the series of the band passages 80 and through the band-passing hole of the right press 54 to the outside of the main body. A predetermined amount of the band fed to the outside of the main body is manually stretched upon an article to be strapped and disposed upon an upper surface table (not shown), and then the front end of the band is inserted into a band-inserting portion 82 so as to perform a series of tightening, fusing and cutting operations thereon, and then band feeding within the final process is performed for a period set by means of a timer. If an external force which interferes with the advance of the feeding band, such as, for example, friction between the band and the respective mechanisms, is encountered during the band feeding, the band may be folded bent out of shape in the form of a superimposed waveform below a slide table 18 having wide spaces formed upon the upper and lower surfaces thereof and within the band chute 74, resulting in a so-called jam having a zig-zag form or a similar jam within the band passage 80. In such a case, a very complex operation is required such as, for example, the removal of the support plate 88 from the base plate 41 so as to permit the removal of the jammed band from the portion thereof and the cutting of the band at the jammed portions thereof which cannot be re-used because the band at the jammed portions has undergone plastic deformation, such that a most serious situation may be developed from the standpoint of the operation of the strapping machine. The above situation frequently occurs when a flexible, narrow and soft plastic band is used.

However, in the above-described prior art, the feed cover 75 is pivotably mounted, under the influence of its own weight, by means of shaft 81 provided with the torsion spring 79 of a relatively weak opposing force and is merely slightly biased in the direction toward the feed roller 23, so that an external force raises to some degree the front end portion of the feed cover 75 through means of the band. The band which is loosened to a degree corresponding to the raised distance of the cover 75 is retained between the stepped portion 66 of the base plate 41 and the stepped portion 67 provided upon the front end portion of the feed cover 75. In such a way, the external force is momentarily released and the band is smoothly fed to the outside of the main body by means of both, continuously rotating rollers.

In the aforenoted Japanese U.M. Laid Open Publication No. 129703/1986, the rear end finger portion of the feed cover 75 is pivotably supported so as to release the front end portion of the feed cover 75. For this reason, an article to be strapped is nearly always situated upon the upper portion of the feed cover 75 having the aforenoted construction, so that the feed cover 75, which contacts the bottom surface of the article to be strapped and which is hence not opened to a large extent, can resolve small jam problems but cannot resolve large jam problems.

In addition, even if the pivotable fulcrum is transferred to a position which is defined at a more rear and lower location with respect to the side of the upper roller 24 and the feed cover 75 is prevented to contact the bottom surface portion of the article to be strapped so that the feed cover 75 can be opened to a great extent and so that the band can be fed to the outside of the main body so as to free the band in the form of a ring, the ring portion of the band is sent out toward the bottom surface of the article to be strapped upon the upper portion thereof and eventually strikes the bottom surface thereof, whereby the band has its escape cut off and a jam is produced. Although the article to be strapped may be instantly transferred, of course, from the upper table after completion of the strapping operation, removal of the article to be strapped, which has completed the strapping operation, from the upper table is difficult from the standpoint of operability when a jam is produced with respect to the band. For this reason, the ring-like band which comes out when the feed cover 75 is opened strikes the bottom portion of the article to be strapped, thereby producing a jam as in the case with conventional examples. Because the feed roller 23 rotates so as to discharge the band irrespective of the force impressed upon the band which hinders the movement of the band when the band is fed, the band has its escape cut off so as to produce a jam below the slide table 18, within the band chute 74 or within the band passage 80. In the worst situation, the band may be caught between the stepped portion 66, of a circular notch 71 provided in series with the stepped portion 66 formed upon the base plate 41, and the feed roller 23.

In such a case, therefore, the jammed portion of the band should be cut because it cannot be reset for use due to plastic deformation thereof and the band must be pulled with a large amount of strength in order to resolve the worst jam in which the band may be caught between the notch 71 and the feed roller 23, so that there is a serious problem in operational efficiency from the standpoint of waste of the band material.

All conventional strapping machines as well as the above-described conventional means have used three-phase or single phase induction motors for providing versatility in accordance with the power sources of three-phase alternating current distributed to factories and the like (200 V) or general domestic single phase alternating current power sources (100 V), whereby the induction motor is rotated at a predetermined speed of rotation, in the area and the rotational force is transmitted to a feed roller through means of a speed-reducing mechanism and a friction clutch. Although such induction motors comprise common drive means, conventional strapping machines have used AC motors using the above friction clutches, electromagnetic clutches and various types of movement transmission mechanisms by only emphasizing manufacturing inexpensive strapping machines without the use of parts such as, for example, A/C transformation devices and rectifiers. Consequently, the above-described prior art must indispensably use friction clutches, one-way clutches and various types of movement transmission mechanisms. Accordingly there are problems encompassing a large number of parts, complex assembling processes and large-sized apparatus.

In order to obtain high torque during the secondary tightening operation, the rotational speed of the motor is reduced by means of a speed reducing mechanism and the feed roller is merely subjected to forward and reverse rotation at a predetermined low speed of rotation. For this reason, the band-feeding is slow and the band-tightening force is weak regardless of however strong the compressive force of the upper roller 24 on the feed roller 23 is made. Although the strapping machine is suited for strapping a relatively small special article to be strapped and is used as a table strapping machine, usages such as, for example, the motor being directly connected to apparatus installed upon an automatic strapping line, and the strapping of wood, wooden boxes and relatively large carton boxes has involved some difficulty.

OBJECTS OF THE INVENTION

In the present invention which has been developed for resolving the above-described problems, it is an object of the invention to momentarily release the force applied to a jammed band regardless of the presence of an article to be strapped upon the upper table of a strapping machine and thereby prevent both large and small jams from securing so as to enable smooth strapping operations to proceed.

It is another object of the invention to achieve compactness of the entire band feeding and tightening mechanism and to simultaneously enable band feeding and primary tightening at a high rate of speed and secondary tightening at a low rate of speed and high torque conditions.

SUMMARY OF THE INVENTION

In order to achieve the above objects in the present invention, a chute guide for forming a band passage is provided at a position facing the outer peripheral surface of the feed roller which is disposed forward of, as viewed along the band feeding direction, a surface portion of outer peripheral surface of the feed roller which is brought into contact with the upper roller, the chute guide being pivotally rotated by means of an external force which tends to jam the band because of friction between the band and the respective mechanisms of the main body, the rear end portion of the chute guide being pushed upwardly, and the band which is loosened by means of a length corresponding to the pushed-up height of the chute guide is retained within the band passage of the chute guide while the external force is momentarily released, whereby the band can be smoothly fed to the outside of the main body without being jammed regardless of the continuously rotating feed roller and upper roller. Even when the external force is relatively large, the rear end portion of the chute guide is opened to a large extent irrespective of the presence of the article to be strapped upon the upper table, whereby the band can be fed to the outside of the feed unit in the form of a ring without jamming.

A sensor for detecting the pivotal rotation of the chute guide is provided within the vicinity of the chute guide, and a signal from the sensor stops the forward rotation of the feed roller so as to prevent the band from overfeeding.

When the feed roller is driven by means of a series motor which decreases the speed with increasing load and the band is reversed under high speed, low torque conditions so as to wind the band around an article to be strapped and thereby achieve primary tightening, the torque of the direct winding motor is increased in inverse proportion to the speed of rotation thereof, whereby the band is closely tightened around the article to be strapped at a low rate of speed and high torque so as to achieve secondary tightening.

BRIEF DESCRIPTION OF THE DRAWINGS

Various other objects, features, and attendant advantages of the present invention will become better understood from the following detailed description, when considered in connection with the accompanying drawings, in which like reference characters designate like or corresponding parts throughout the several views, and wherein:

FIG. 1 illustrates an embodiment of the present invention wherein:

FIG. 1(A) is a side view thereof,

FIG. 1(B) is a cross-sectional view taken along a line 1B—1B in FIG. 1(A) and FIG. 1(C), FIGS. 2 to 4 illustrate the related prior art, wherein FIG. 2 is an exploded perspective view, FIG. 3(A) is a side view, FIG. 3(B) is a cross-sectional view, and FIG. 4 is a perspective view.

DETAILED DESCRIPTION OF THE PREFERRED EMBODIMENT

Figure 1:
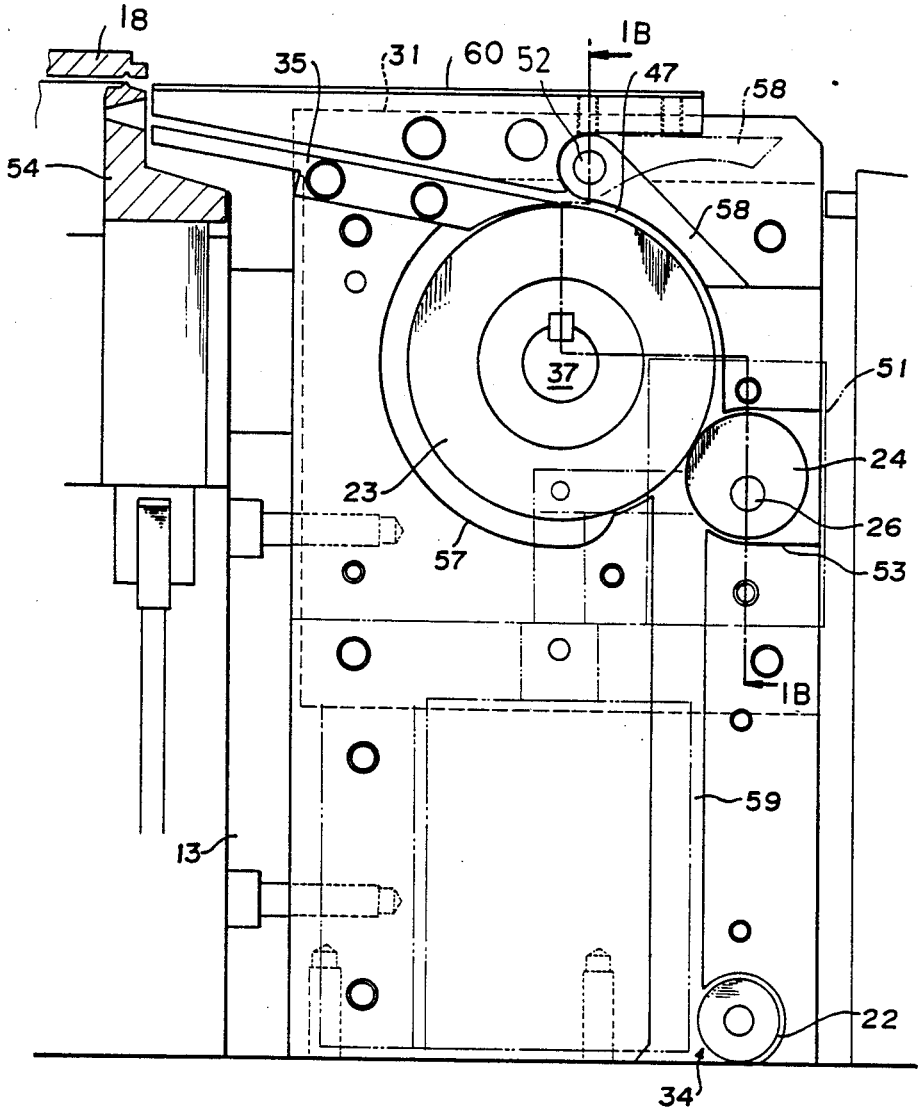
Figure 1:
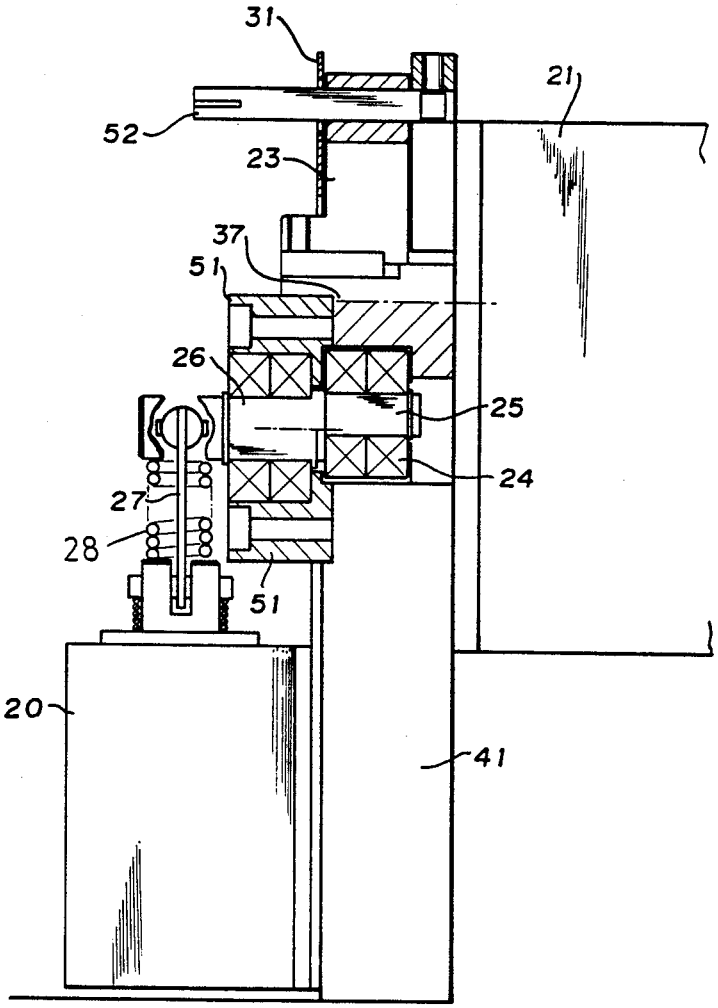

The details of the present invention will now be described with reference to the embodiment illustrated in FIGS. 1(A) to (D).

Within a band feeding and tightening apparatus of the illustrated embodiment, a pair of feed rollers are composed of a feed roller 23 connected to a driving source attached to a base plate 41, and an upper roller 24 which is brought into contact, and caused to rotate, with the feed roller 23.

A motor 21 is connected to an AC power source through the intermediary of a rectifying device and is a DC series motor which can vary the speed of rotation at a rated voltage of, for example, 140 V and an operating voltage of, for example, 40 V to 80 V and which can adjust the tightening power. The motor is integrally provided with a speed reducing mechanism 39 and is secured to the base plate 41. The output shaft 37 of the speed reducing mechanism 39 projects through the base plate 41 with the feed roller 23 being directly connected to the end of the shaft.

The feed roller 23 is rotatably mounted upon a circular cut-away portion of a stepped portion 57 composed of a straight line and a curve cut upon the base plate 41 and the upper roller 24 is provided upon the outer periphery of the feed roller 23 so as to be capable of free compressive contact with roller 23. The base plate 41 is provided with a cut-away stepped portion 53 which is maintained away from the lower surface of the outer periphery of the upper roller 24 through the intermediary of a band-passing groove 59 formed continuously with the stepped portion 57 and in the form of a narrow groove which is slightly wider than the thickness of the band. The widths of the stepped portions 57 and 53 and the band-passing groove 59 are somewhat larger than the width of the band used herein. Referring to FIGS.

1(A) and 1(B), a supporting plate 31 is attached to the base plate 41 so as to cover the stepped portions 57 and 53, the band-passing groove 59, and a later-described band chute 35, and the respective rollers are rotatably held between the base plate 41 and the supporting plate 31 whereby the band is prevented from escaping from both rollers and the band passage when the band is fed and restored.

The upper roller 24 is composed of bearings inserted within the shaft 25 as illustrated in FIG. 1(B), an eccentric shaft 26 projecting integrally with the front end of the shaft 25 so as to project through the band supporting plate 31 and is pivotably supported by means of a bearing plate 51 secured to the supporting plate 31 and is further connected to a rod 27, biased by means of a spring 28, of a solenoid 20 at a head portion thereof which projects outwardly from the bearing plate 51. The eccentric shaft 26 is biased by means of the spring 28 in a direction in which the shaft 25 of the upper roller 24 is pivoted about shaft 26 such that the outer periphery of the upper roller 24 is separated from the outer periphery of the feed roller 23.

Figure 1C:
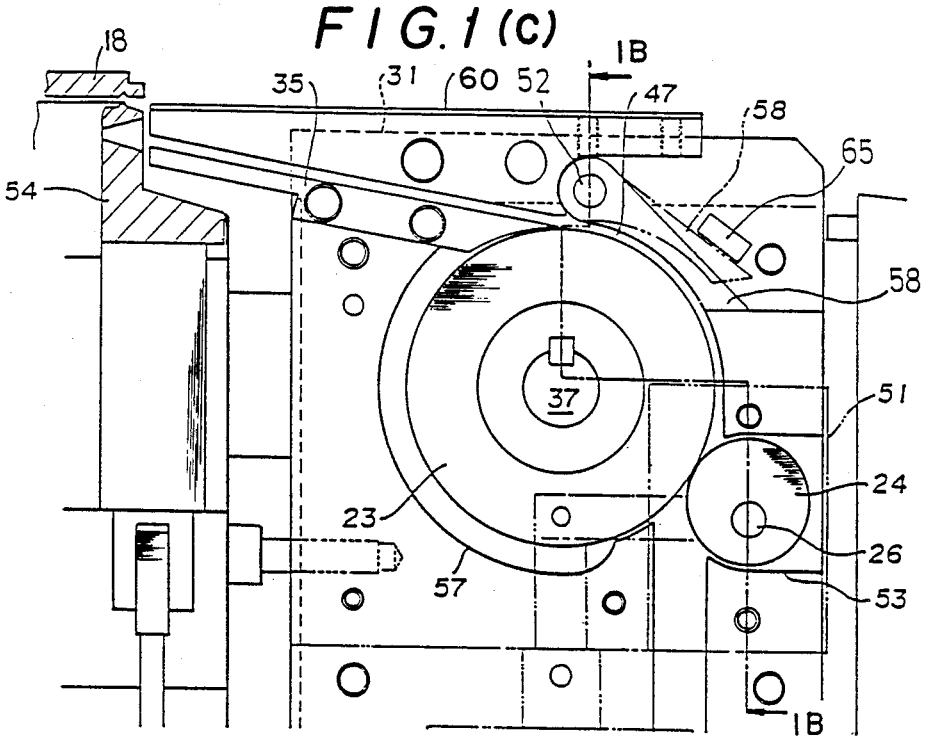
FIG. 1(C) is a partial view, similar to that of FIG. 1(A), showing the attached condition of a sensor for detecting the pivotal rotation of a chute guide.
Figure 1D:
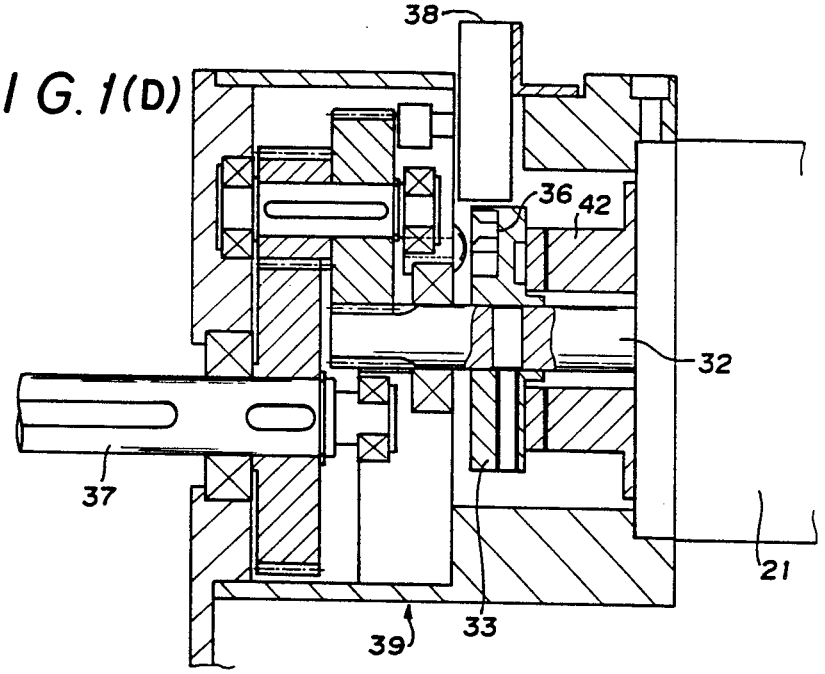
FIG. 1(D) is a cross-sectional view.
Figure 2:
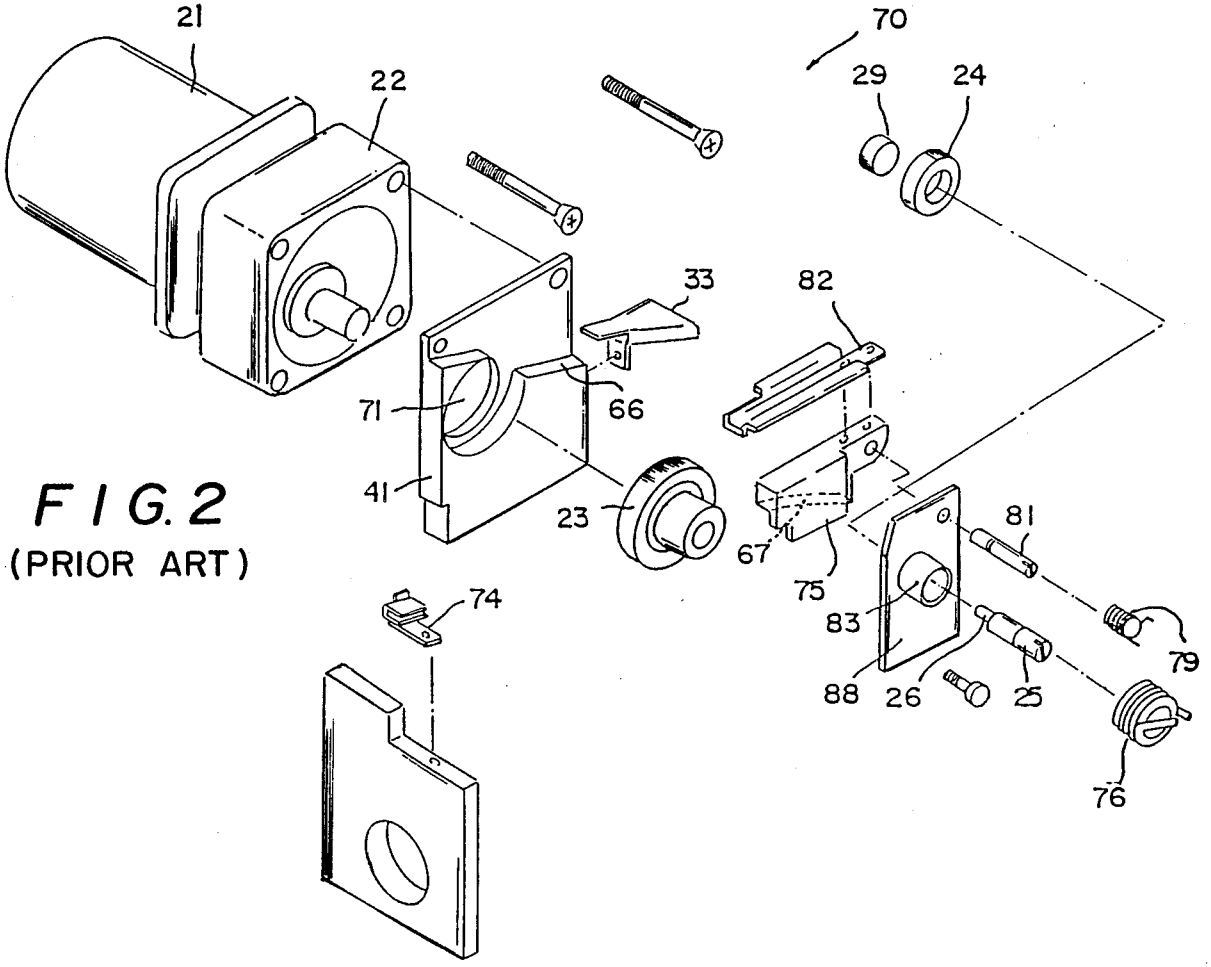
FIG. 2 (PRIOR ART)
Figure 3:
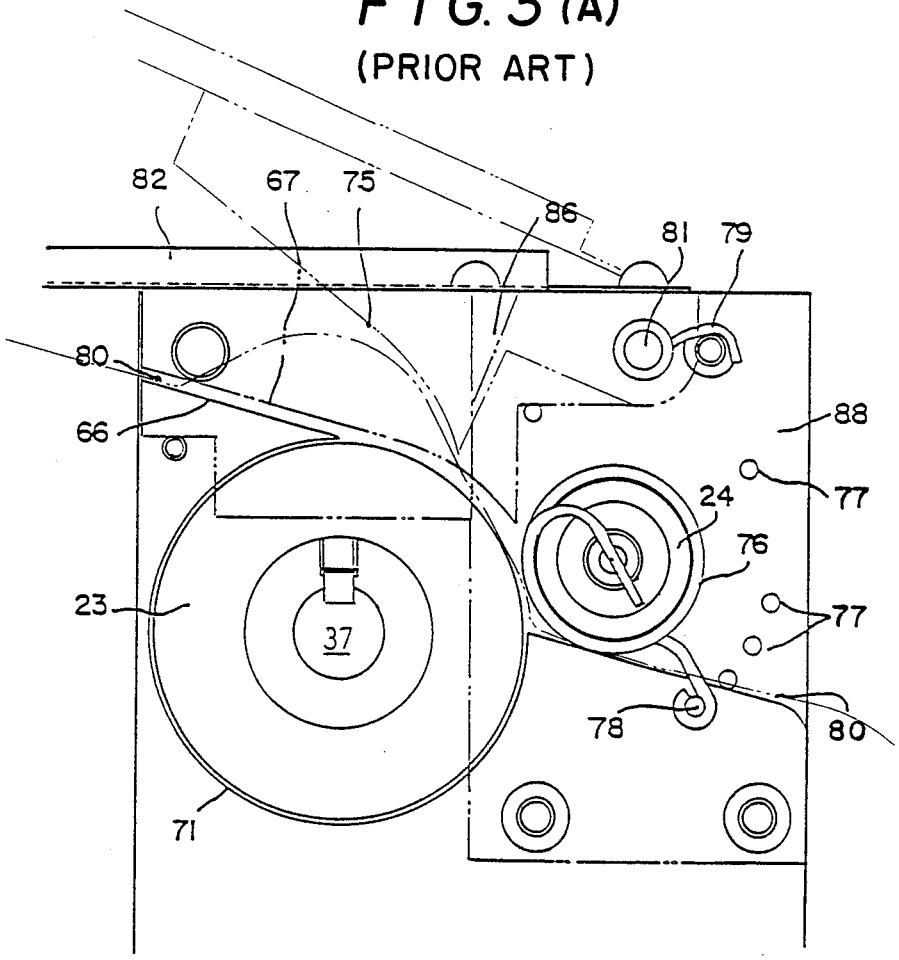
FIG. 3 (A) (PRIOR ART)

As illustrated in FIG. 1(D), the driving shaft 32 of the motor 21 faces the inside of the speed-reducing mechanism 39, the front end of the driving shaft 32 is provided with a pinion, and the rear end thereof is provided with a lock ring 33, in which a magnet 36 is embedded. A rotation detecting member 38 detects the speed of rotation of the driving shaft 32 by means of the magnet 36 and is connected to a rotation detecting circuit which emits an output signal when the detected speed of rotation thereof is less than a predetermined speed of rotation.

A guide roller 22 is attached to the band-inserting inlet 34 of the band passing groove 59 as seen in FIG. 1(A), and a band leading end-inserting portion 60 is attached to the base plate 41 on the upper surface of the band chute 35. A chute guide 58 is biased by means of a spring such as, for example, a torsion spring. The front end of the chute guide 58 is normally secured upon the stepped portion of the base plate 41. A gap for allowing the band to pass therethrough is defined between the arch portion of the lower surface of the guide 58 and the upper surface of the outer periphery of the feed roller 23 so as to form a band passage 47 about the feed roller 23 and the guide 58 is pivotably attached by means of a pin 52 as is illustrated in a double-dotted line in FIG. 1(A) so as to open the upper surface of the outer periphery of the feed roller 23. Referring to FIG. 1(D), an electromagnetic brake 42 is mounted upon the output driving shaft 32 of the motor 21.

The apparatus of the present invention is provided with the respective press members for grasping the leading end and the supplying end of the band by means of a cam shaft rotatably driven by means of a cam shaft motor and for performing fusion-bonding of superposed portions of the aforenoted ends and for cutting the same subsequent to the fusion-bonding thereof, and numerals 54 and 18 denote a right press and a slide table, respectively, in FIGS. 1(A) and 1(C).

The operation of the apparatus of the present invention formed so as to have the above structure is described below. When the band is inserted into the band-inserting inlet 34 of the band-passing groove 59 from a band reel (not shown) through means of the guide roller 22, a gap is provided between both rollers 23 and 24 and the band is inserted into the gap because the eccentric shaft 26 of the upper roller 24 is biased by means of the spring 28 such that the roller 24 is spaced away from roller 23. When the motor 21 is then rotated for forward advancement of the band, a timer is simultaneously operated so as to apply voltage to and energize solenoid 20 for a predetermined period of time so as to pivotably rotate the rod 27. Because the eccentric shaft 26 is pivotably rotated about the feed roller 23 in the above manner, the upper roller 24 is brought into compressive contact with the feed roller 23 so as to hold the band between both rollers. Because the feed roller 23 is rotated for only a period predetermined by means of the timer, the band passes through the inside of the band chute 35 by means of the band passage 47 defined between the feed roller 23 and the lower surface of the chute guide 58 so as to feed a predetermined amount of the band toward the outside of the main body, whereby the band is positioned or wound in the form of a loop-shape around an article to be strapped. Subsequently, the time-up signal of the timer or a signal detecting the leading end of the band which has been inserted into the lower surface of the slide table 18 of a seal unit through means of a band leading-end-inserting portion 60 turns the solenoid OFF, such that the compressive contact of the upper roller 24 with the feed roller 23 by means of the solenoid 20 is released. The signal is simultaneously applied to a cam shaft motor (not shown) so as to start rotation of the cam shaft and then the right press 54 grasps the band leading-end between the slide table 18, and a signal of a switch which detects the grasping of the band leading-end in view of the rotation angle of the cam shaft stops the cam shaft. The stop signal of the cam shaft motor again excites the solenoid 20, so that the upper roller 24 is brought into compressive contact with the feed roller 23. Because the stop signal of the cam shaft motor is converted into a signal for starting the reverse rotation driving of the motor 21, the band held between both rollers 23 and 24 is restored at a high rate of speed and at low torque whereby the same is wound in accordance with an initial primary tightening made and subsequently tightened in accordance with a secondary tightening made around the article to be strapped. While the secondary tightening made is being performed, the speed of rotation of the feed roller 23 is decreased and the torque becomes greater with the decreased speed of rotation thereof. The torque is transmitted from the output shaft 32 of the motor 21 to the feed roller 23 through the intermediary of the output shaft 37 of the speed-reducing mechanism. The series motor 21 causes the feed roller 23 to rotate at a low rate of speed and high torque whereby the band is closely tightened around the article to be strapped. In this case, the speed of rotation of the magnet 36 within the lock ring 33 provided upon the end of the output shaft 32 of the motor 21 is decreased and the magnet 36 is finally stopped. The rotation detecting member 38 provided within the vicinity of the rotating locus of the magnet 36 produces a detecting signal which detects the reduced speed of rotation of the output shaft 37 or of the feed roller 23 of the speed reducing mechanism (or a complete reduction of speed including a stopping thereof) so as to actuate an electromagnetic brake 42 upon the output shaft 32 of the motor thereby stopping the reverse rotation driving thereof. Simultaneously, the cam shaft motor is again rotated, while the band-supplying end is retained in its tightened condition by means of the left press so as to turn the solenoid 20 OFF, whereby the compressive contact of the upper roller 24 upon the feed roller 23 is released. A middle press is then raised so as to perform fusion-bonding of the superposed portions of both the leading and supplying ends of the band by means of a heater inserted into the above superposed portions, whereby the band fusion-bonding process is completed so as to stop the cam shaft motor. At the same time, the solenoid is actuated as described above and the electromagnetic brake 42 disposed upon the output shaft 32 of the motor 21 is released so as to perform forward rotation of the motor 21 for a predetermined period, whereby a predetermined amount of the band is fed to the outside of the main body at low torque and high speed so as to finish one portion of the strapping operation. If any external force such as friction of the band with the respective mechanisms is exterted upon the fed band so as to arrest the advance thereof, a reaction which tends to push the band backwardly in a direction reverse to the forward direction thereof is exerted most effectively within the band passage 47 which is disposed nearest to the nip of the feed roller 23 and the upper roller 24 which provide the band with its running force. In contrast, because the chute guide 58 is merely slightly energized, in the direction toward the feed roller 23, by means of a torsion spring of a relative weak opposing force exhibited by means of the band, the external force pushes the rear end portion of the chute guide 58 upwardly as shown by means of a double dotted lines in FIG. 1(A), and the band which is loosened by means of a length corresponding to the pushed-up length is retained within the band passage 47 of the band chute 35 so as to momentarily release the external force. For this reason, the band can be smoothly fed to the outside of the main body by means of both continuously rotating rollers.

Because the rear end portion of the chute guide 58 is opened to a large extent, particularly when the external force is relatively continuous and great, the band can be fed to the outside of the apparatus without being subjected to an obstruction cause, for example, by means of the article to be strapped. In this case, it is desirable to reverse rotate the feed roller 23, return the entire band within the main body to the outside of the main body and reset the apparatus.

Accordingly, the present invention can eliminate not only conventional small jams but also large jams that could not be resolved even by means of the development of Japanese U.M. Laid Open Publication No. 129703/1986 and furthermore, the present invention can avoid the worse situation under which the band is caught between the rear, portion of the band chute 35 and the outer periphery of the feed roller 23, thereby enabling performance of a smooth strapping operation.

When the external force is relatively continuous and great, the rear end of the chute guide 58 is opened so as to permit the band to escape toward the outside of the apparatus in the form of a ring or loop in a direction opposite that of band chute 35. Because the band is emitted for a long period of time until the completion of the setting time of the forward rotation timer, it takes considerable time until the band is returned to the outside of the main body and is reset. When the rear portion of the chute guide 58 is, as illustrated in FIG. 1(C), opened by means of the band being jammed and is slightly rotated, a sensor 65, attached at an appropriate position with respect to which the rear portion of the chute guide 58 approalches, emits a signal such that the forward rotation of the band is discontinued when the sensor is turned ON and the forward rotation is restarted when the sensor is turned OFF. Accordingly, there is no jam that cannot be resolved by momentarily raising the chute guide 58 and momentarily releasing the external force imposed thereon, such that the band is again recovered to its normal operation and the band is smoothly fed to the outside of the main body by means of the continuously rotating feed roller and the upper roller. When the external force is so great that it cannot be resolved even by momentarily releasing it, the sensor 65 is turned ON and the forward rotation of the band is turned OFF as a result of slightly opening the rear portion of the chute guide 58, such that the band is not sent out toward the outside of the apparatus for a long period of time.

The electromagnetic brake 42 is not indispensable because the objects of the invention can be accomplished by turning the motor 21 ON and OFF in accordance with the above embodiment.

As described above, according to the present invention, when the band is fed to the outside of the main body by means of the feed roller, not only conventional small jams but also large jams can be eliminated irrespective of the presence of an article to be strapped upon the upper table and even when an external force is applied to the band, whereby the worst situation under which the band is caught between the rear portion of the band chute and the outer periphery of the feed roller can be resolved so as to enable a smooth strapping operation to be performed.

Because a series motor in which increased load decreases the speed causes a feed roller to be driven whereby the primary tightening operation can be made at a high rate of speed and a low torque and the secondary tightening operation can be made at a low rate of speed and a high torque according to the present invention, a close tightening force rendering the present invention a universal strapping machine can be obtained, and in addition, the entire strapping machine is rendered compact.

Obviously, many modifications and variations of the present invention are possible in light of the above teachings. It is therefore to be understood that within the scope of the appended claims, the present invention may be practiced otherwise than as specifically described herein.

What is claimed is:

1. A band feeding and tightening apparatus in a strapping machine, comprising:

a housing;

a strapping band inlet means and strapping band outlet means defined within said housing;

a feed roller rotatably mounted within said housing;

motor drive means operatively connected to said feed roller for rotating said feed roller in first strapping band advancing and second strapping band retracting directions along a strapping band movement path;

a follower roller operatively cooperative with said feed roller for advancing said strapping band from said strapping band inlet means toward said strapping band outlet means in said first strapping band advancing direction along said strapping band movement path, and for retracting said strapping band from said strapping band outlet means toward said strapping band inlet means in said second strapping band retracting direction along said strapping band movement path;

outlet means defined within said housing within the vicinity of said feed roller for permitting a portion of said strapping band to escape from said housing under abnormal feeding and retracting movement conditions of said strapping band along said strapping band movement path; and chute guide means, disposed within the vicinity of said strapping band escape outlet means and opposite a peripheral portion of said feed roller so as to define therewith a portion of said strapping band movement path, pivotably mounted at a forward end thereof disposed toward said strapping band outlet means such that a rearward end thereof disposed toward said strapping band inlet means pivotably moves away from said peripheral portion of said feed roller so as to permit said strapping band to escape from said housing through said strapping band escape outlet means.

2. A band feeding and tightening apparatus in a strapping machine in accordance with claim 1, wherein said motor drive means is a series motor and is connected to the feed roller through the intermediate of a speed reducing machine.

3. A band feeding and tightening apparatus in a strapping machine in accordance with claim 2, wherein a series or a compound DC motor connected to an alternating power source through a rectifier is directly connected to the feed roller through a speed reducing device.

4. A band feeding and tightening apparatus in a strapping machine in accordance withh claim 2, wherein a single phase alternating current series commutator motor is directly connected to the feed roller through a speed reducing machine.

5. A band feeding and tightening apparatus in a strapping machine in accordance with claim 1, wherein a sensor for detecting the opening of said chute guide means as said rearward end of said chute guide means moves away from said peripheral portion of said feed roller is provided in the vicinity of the chute guide means and wherein the detecting signal of said sensor freely drives and stops the motor drive means.

6. Apparatus as set forth in claim 1, wherein:

said follower roller is eccentrically mounted within said housing so as to be movable toward and away from said feed roller in order to close and open a gap defined between said feed and follower rollers so as to grasp and insert/withdraw said strapping band, respectively.

7. Apparatus as set forth in claim 6, further comprising:

spring biasing means operatively connected to said follower roller for moving said follower roller away from said feed roller; and solenoid means operatively connected to said follower roller for moving said follower roller toward said feed roller and against the biasing force of said spring biasing means.

8. Apparatus as set forth in claim 1, wherein:

said chute guide means has an internal surface which has an arcuate configuration corresponding to the peripheral curvature of said peripheral portion of said feed roller opposite which said chute guide means is disposed.

9. Apparatus as set forth in claim 1, further comprising:

spring biasing means operatively connected to said chute guide means for normally biasing said rearward end of said chute guide means toward said peripheral portion of said feed roller.

10. Apparatus as set forth in claim 1, wherein:

said strapping band inlet means is defined within a bottom portion of said housing;

said strapping band outlet means is defined within a front wall portion of said housing; and said strapping band escape outlet means is defined within a rear wall portion of said housing.

* * * * *